US005718179A

United States Patent [19]

Johnson et al.

[11] Patent Number: 5,718,179

[45] Date of Patent: Feb. 17, 1998

[54] MODULAR TABLE ASSEMBLY

[75] Inventors: Timothy K. Johnson, Grand Rapids; Mary Lou Brodbeck, Douglas, both of Mich.

[73] Assignee: Steelcase Inc., Grand Rapids, Mich.

[21] Appl. No.: 772,426

[22] Filed: Dec. 24, 1996

Related U.S. Application Data

[63] Continuation of Ser. No. 330,422, Oct. 28, 1994, abandoned.

[51] Int. Cl.[6] ..... A47B 3/06

[52] U.S. Cl. ..... 108/153; 108/157; 108/50; 248/188

[58] Field of Search ..... 108/150, 153, 108/157, 50; 312/223.6, 194; 248/188

[56] References Cited

U.S. PATENT DOCUMENTS

| | | | |
|---|---|---|---|
| D. 65,635 | 9/1924 | Clement . | |
| D. 222,278 | 10/1971 | Thornhill . | |
| 335,140 | 2/1886 | Mets . | |
| 3,756,169 | 9/1973 | Dybvig . | |
| 4,043,278 | 8/1977 | Kessler et al. . | |
| 4,448,378 | 5/1984 | Binfaré . | |
| 4,760,802 | 8/1988 | Leong . | |
| 4,941,412 | 7/1990 | Engel . | |
| 5,037,232 | 8/1991 | Pakdipanichpong | 108/150 X |
| 5,050,829 | 9/1991 | Sykes | 108/153 X |
| 5,144,896 | 9/1992 | Fortsch | 312/223.6 X |
| 5,150,554 | 9/1992 | Quinlan, Jr. et al. | 52/282 |
| 5,154,126 | 10/1992 | Newhouse et al. | 108/50 |
| 5,163,373 | 11/1992 | Anderson et al. | 108/153 |
| 5,220,871 | 6/1993 | Grund et al. | 108/50 |
| 5,232,303 | 8/1993 | Rubner | 248/188 X |
| 5,333,423 | 8/1994 | Propst | 248/188 X |
| 5,435,254 | 7/1995 | Amey et al. | 108/50 X |

*Primary Examiner*—José V. Chen

*Attorney, Agent, or Firm*—Price,Heneveld, Cooper, DeWitt & Litton

[57] ABSTRACT

A modular table assembly and kit include a table top panel member with a plurality of discrete receptacle sets disposed on the panel. A plurality of leg sets is provided with each one of the leg sets corresponding to a respective one of the plurality of receptacle sets. Whereby, a selected leg set is coupled with its respective receptacle set to assemble a desired table design. The selected leg set may include to least one pedestal with a column portion extending between a table end and a base end. The table end of the leg includes a key that seats in it respective receptacle to locate the leg relative to the table top. Further, the pedestal may include a wire way passage extending between the table end and the base end to conceal and conduct a wire or cable or the like.

31 Claims, 10 Drawing Sheets

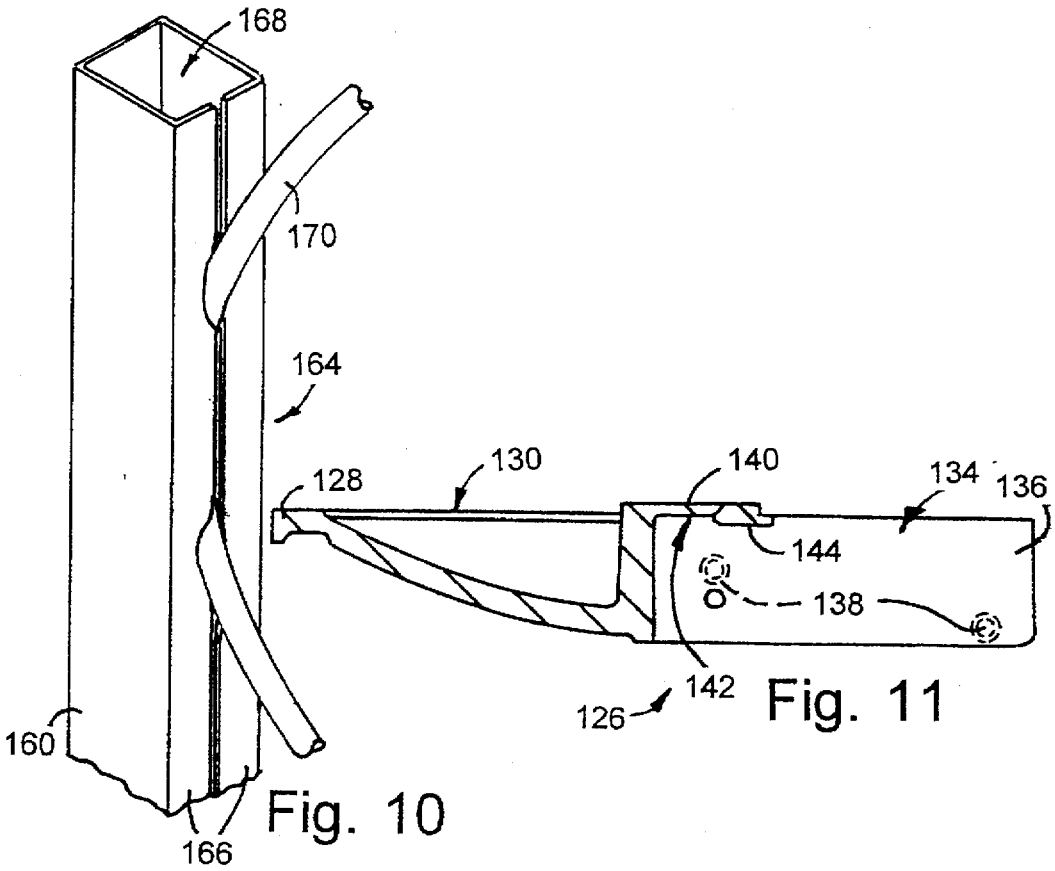
Fig. 10
Fig. 11
Fig. 13
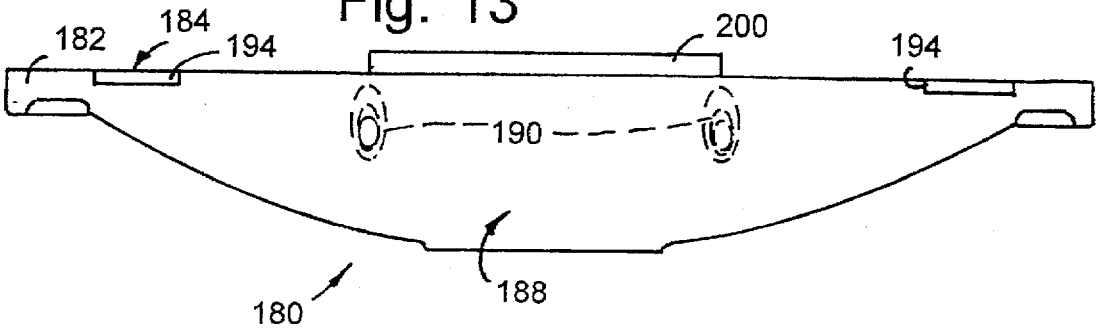

MODULAR TABLE ASSEMBLY

CROSS-REFERENCE TO RELATED APPLICATIONS

This is a continuation of application Ser. No. 08/330,422, filed Oct. 28,1994, now abandoned.

BACKGROUND OF THE INVENTION

The invention relates to tables.

It is common experience for one to find a table assembled by a manufacturer with a particular table top panel and particular table legs, or one or more table pedestals, and the like. The manufacturer will specifically fit and couple these particular components with one another. A table will typically come from the manufacturer either preassembled or previously assembled and disassembled with specific table top and leg components packaged together, including the requisite screws or the like to reassemble the table at the point of use.

This common method of unitized packaging of an assembled table or a previously matched table top and leg components inherently limits a customer's selection from available tables, however. A table supplier has a finite volume of inventory space and can stock only the quantity of inventory that will fit in the given inventory space. This, then, inherently limits the variety of table choices available to a customer, unless the customer is willing to wait for and pay for a custom table.

SUMMARY OF THE INVENTION

Accordingly, a modular table assembly according to the invention has a table top or panel member with a bottom surface. A plurality of receptacle sets are provided on the bottom surface of the table top. And, a plurality of leg sets are provided, each one of the leg sets corresponds to a respective one of the plurality of receptacle sets with a selected one of the plurality of leg sets being coupled with its respective receptacle set to assemble a table having a selected leg design style.

In one aspect of the invention, an end of each leg that is coupled with the table top has a cooperating key that corresponds to and is seated in its respective receptacle. In another aspect of the invention, at least one of the legs has a passage extending along a length of the leg, between a table end of the leg and an opposing base end of the leg. In a further aspect of the invention, the passage includes a member that defines a side of the passage. The member is flexible to be displaced from a first position in which the passage is substantially closed-sided to a second position in which the passage is open-sided to receive an item into or remove an item from the passage, through the side of the passage. The member is also resilient to return to the first position from the second position. In an additional or an alternative aspect of the invention, the passage includes an opening and a guide, each at one of two opposing ends of the leg. The guide directs an item from the other end of the leg to the opening at the one end of the leg.

These and other features, objects, and benefits of the invention will be recognized by those who practice the invention and by those skilled in the art, from the specification, the claims, and the drawing figures.

BRIEF DESCRIPTION OF THE DRAWINGS

FIG. 10 is an enlarged detail, shown in fragmentary perspective view, of the wire way member of FIG. 9;

FIG. 11 is a cross-sectional view along reference line XI—XI of the edge coupling plate of FIG. 9;

FIG. 13 is a side elevational view of a side coupling plate shown in FIG. 12;

DESCRIPTION OF THE PREFERRED EMBODIMENTS

Figure 9:
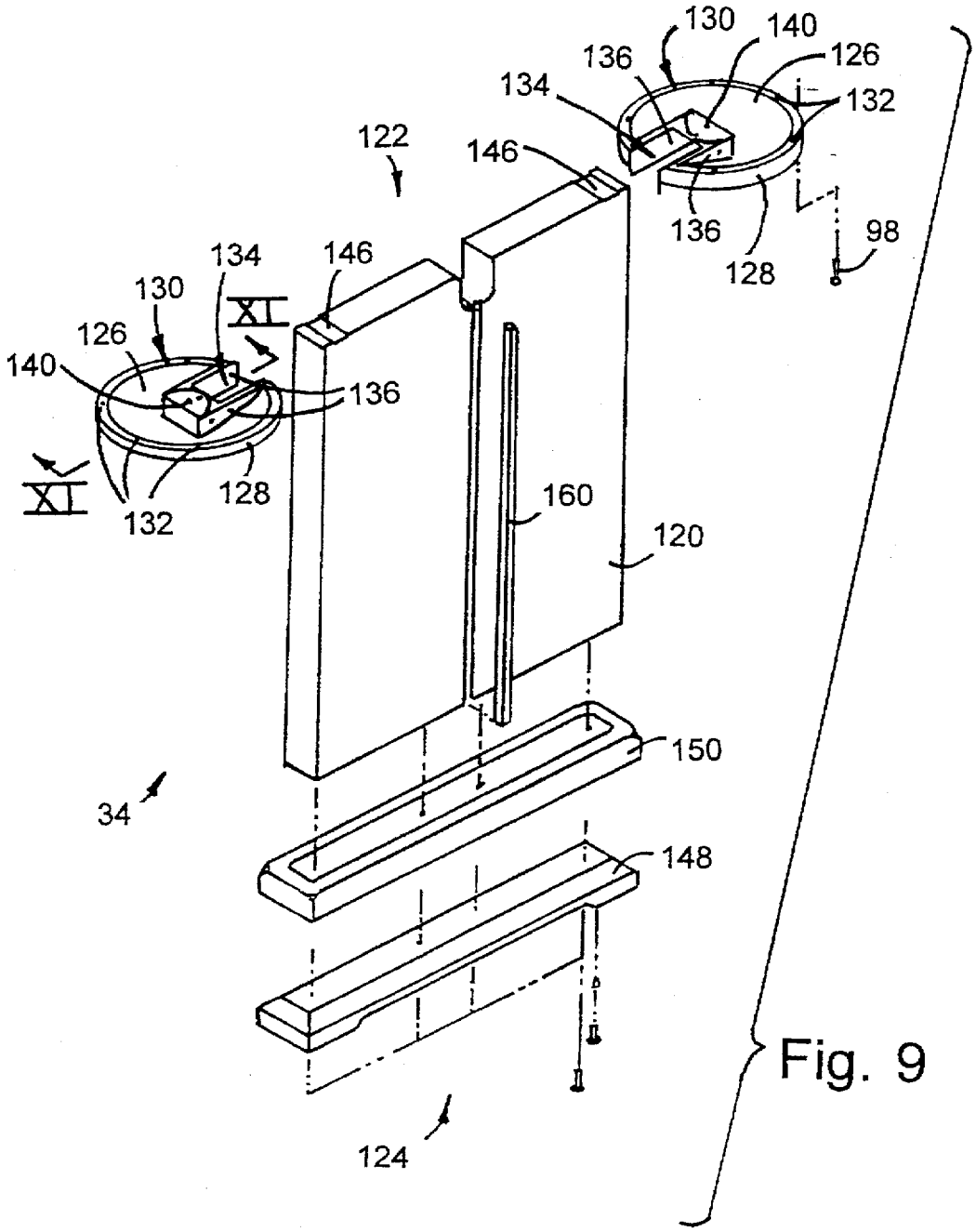
FIG. 9 is an exploded perspective view of one of the panel-type leg assemblies shown in FIG. 4.
Figure 14:
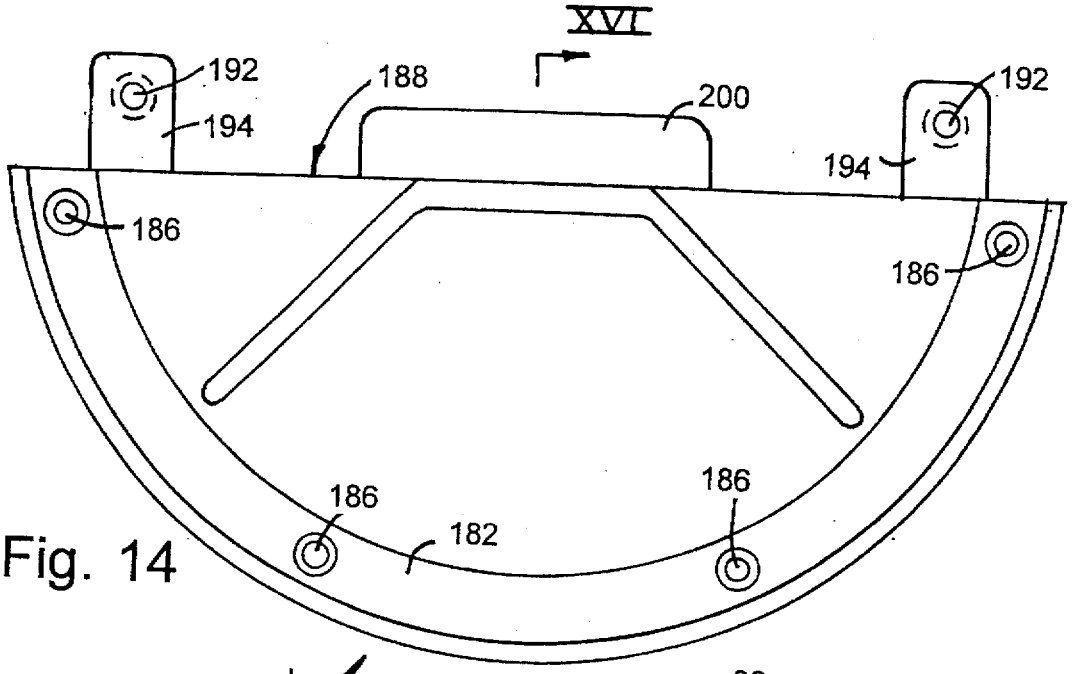
FIG. 14 is a bottom plan view of the side coupling plate of FIG. 13.
Figure 12:
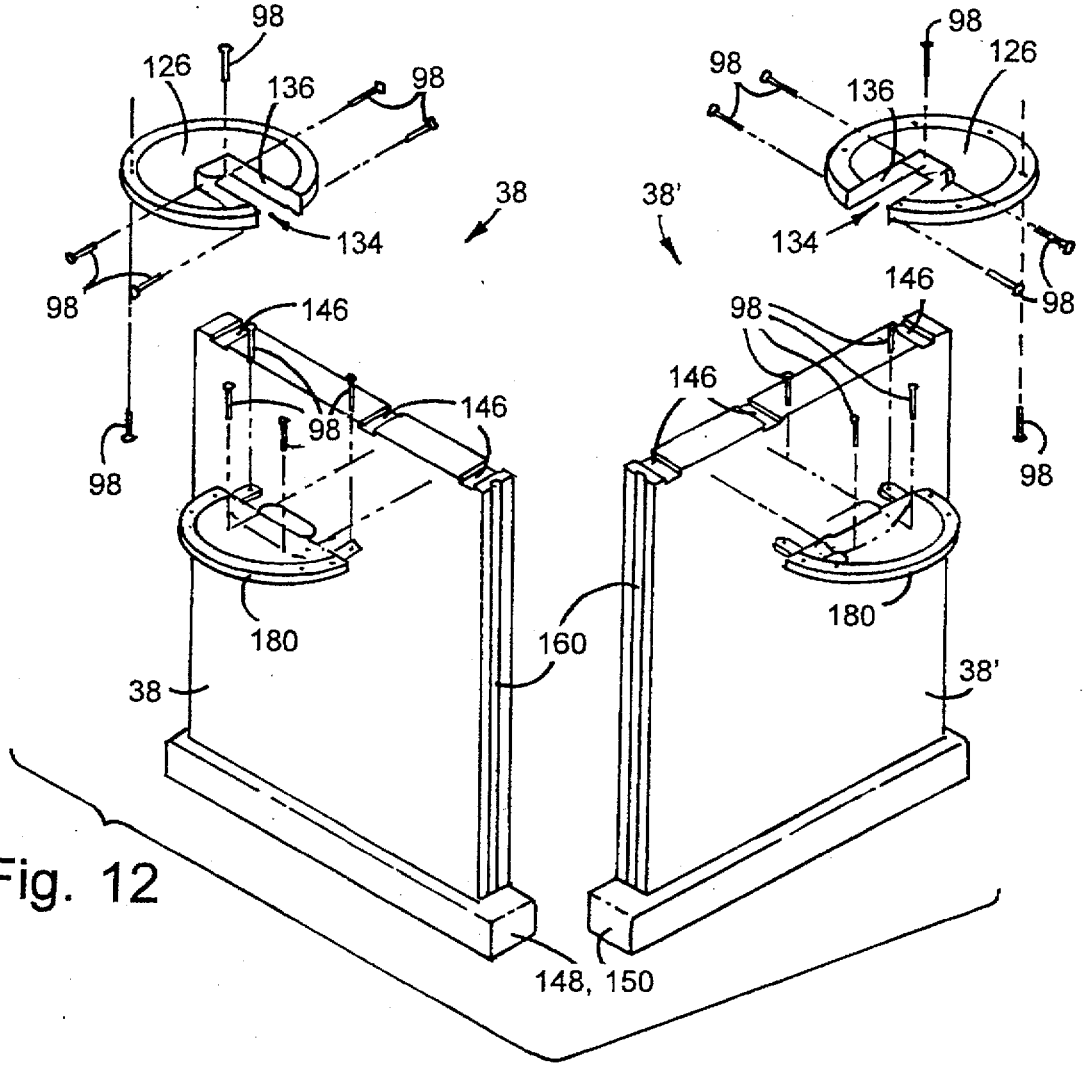
FIG. 12 is an exploded perspective view of the leg assembly shown in FIG. 5.
Figure 15:
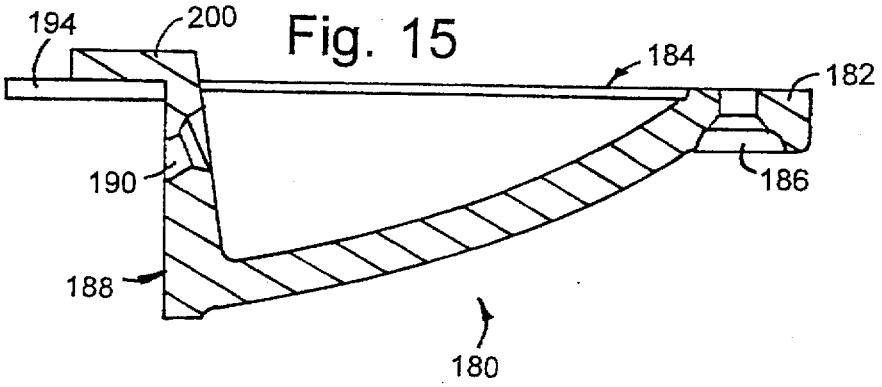
FIG. 15 is a cross-sectional view along line XVI—XVI of FIG. 14.

A table according to the invention is assembled by the selection of a table top 30 (FIG. 1), or the like, and the selection of a requisite number of leg elements from a plurality of leg element sets, including post-type legs 32 (FIGS. 3 and 6), panel legs 34 and 36 (FIGS. 4 and 9), panel legs and 38 and 38' (FIGS. 5 and 12), small panel legs 40 (FIGS. 17 and 18), and pedestal legs 42, 44, 46, and 48 (FIGS. 20 and 22), for example.

Figure 1:
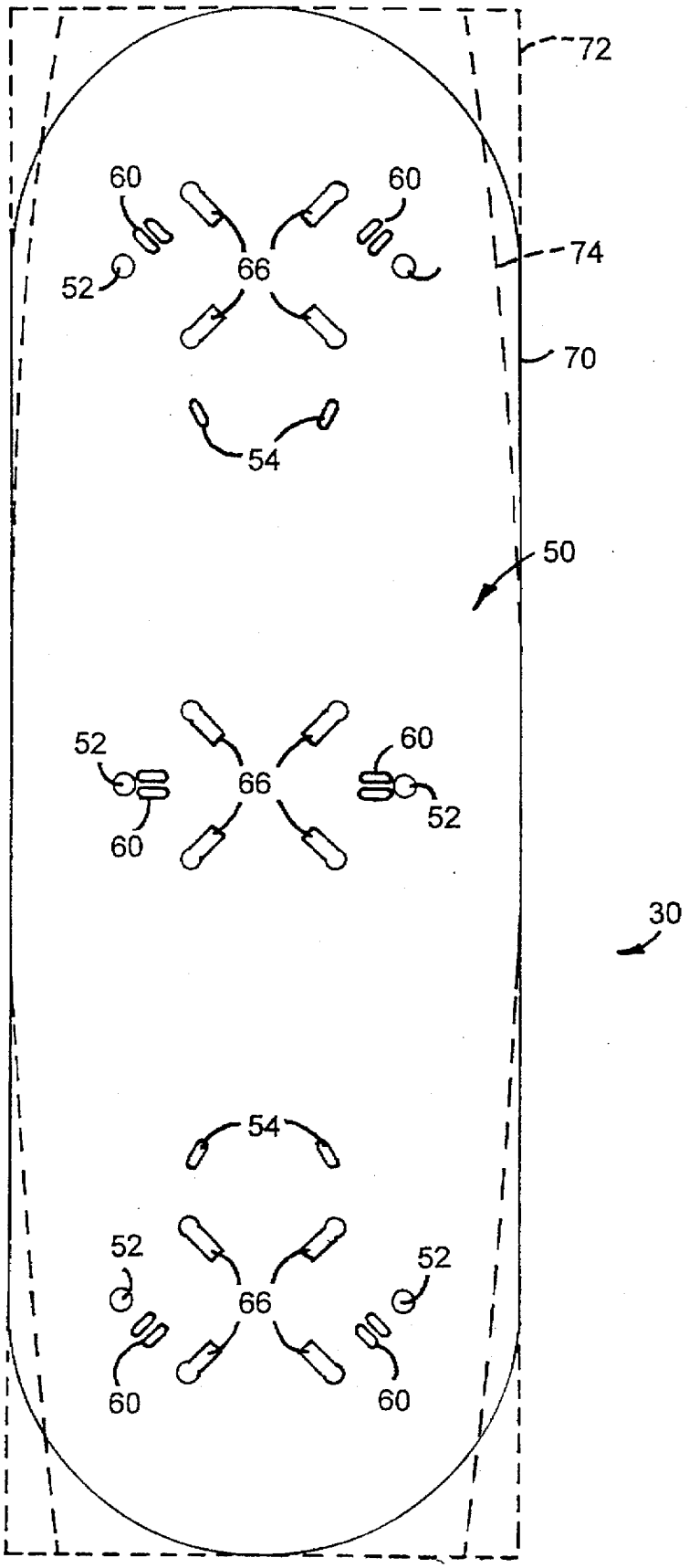
FIG. 1 is a bottom plan view of a table top panel, showing alternative perimeter shapes in phantom.

More particularly with reference to FIG. 1, table top or panel member 30 has a bottom surface 50 and a plurality of receptacle sets provided on the bottom surface. The receptacle sets may be conveniently provided by routing into the bottom surface 50. Table top 30 may be provided with circular recesses 52 and ovoid recesses 54 which are arranged on the bottom surface of table top 30 to define a first receptacle set 56; which is more clearly shown in FIG. 2. Table top 30 may also be provided with pairs of ovoid recesses 60 arranged on bottom surface 50 to define a second receptacle set 62, which is more clearly shown in FIG. 16. Finally, an array of generally keyhole-shaped recesses 66 may be arranged on bottom surface 50 to define a third receptacle set 68, which is more clearly shown in FIG. 19.

Again referring to FIG. 1, table top 30 may have a generally rectangular shape with rounded ends as shown by the solid perimeter line 70, may have a true rectangular shape as shown by the phantom line 72, or may have a truncated ovoid or elliptical shape as indicated by the phantom line 74, for example. Of course, table top 30 may also have any other selected perimeter shape and size. The shape of table top 30 as shown in the drawing figures is for illustration purposes only. Table top 30 may be constructed of any suitable table top material, including, solid or laminated wood or plastic materials which may or may not in turn be finished with a veneer or the like, for example.

Figure 2:
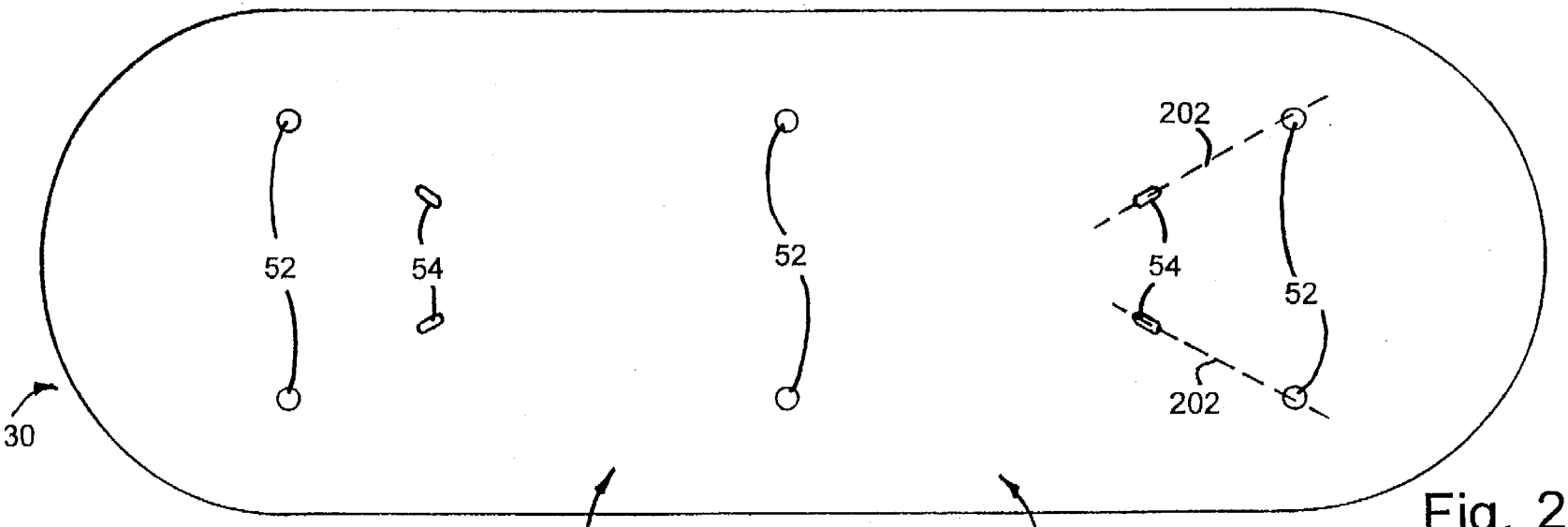
FIG. 2 is the view of FIG. 1 showing only a first one of a number of discreet receptacle sets.
Figure 5:
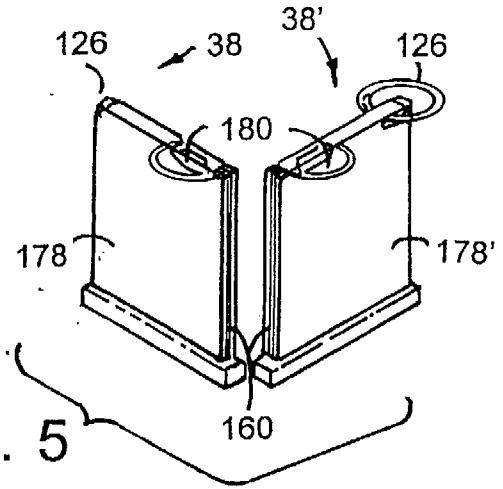
FIG. 5 is a perspective view of an alternative panel leg configured for use with the receptacle set shown in FIG. 2.
Figure 4:
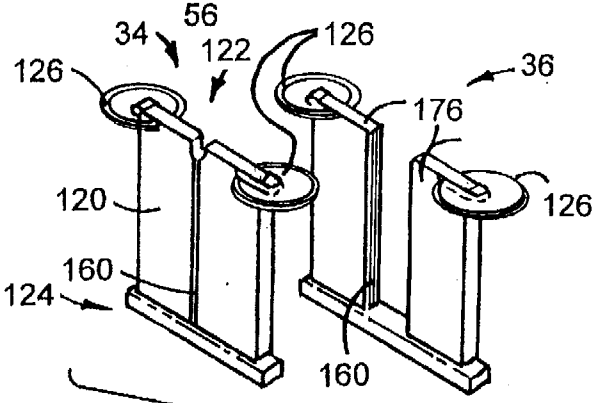
FIG. 4 is a perspective view of two panel-type legs configured for use with the receptacle set shown in FIG. 2.
Figure 3:
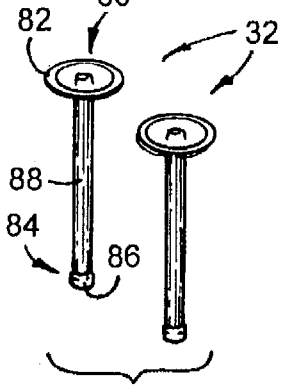
FIG. 3 is a perspective view of two post-type legs configured for use with the receptacle set shown in FIG. 2.
Figure 16:
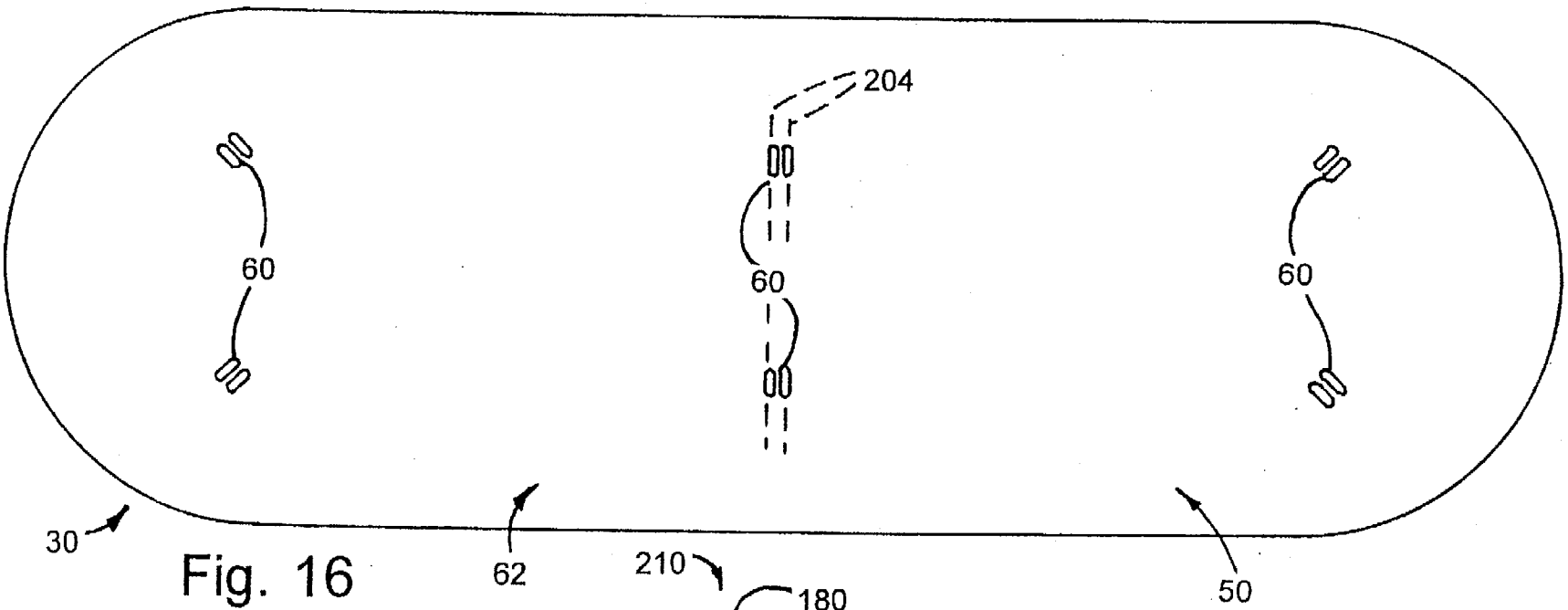
FIG. 16 is the view of FIG. 1 showing only a second one of a number of discreet receptacle sets.
Figure 19:
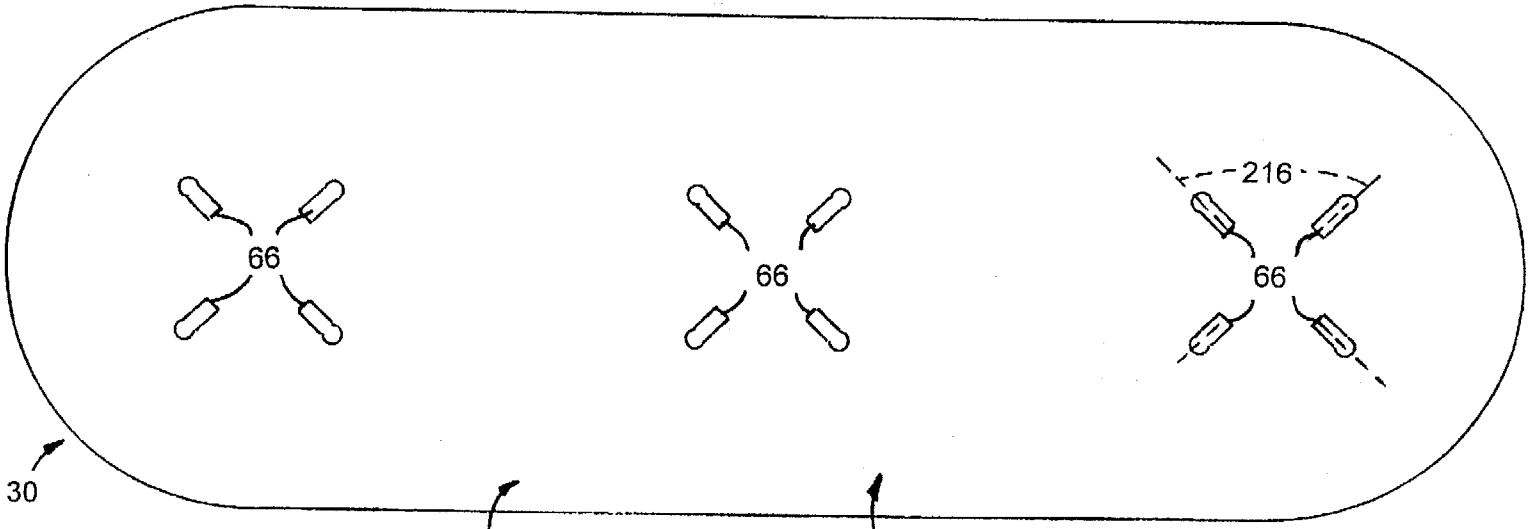
FIG. 19 is the view of FIG. 1 showing only a third one of a number of discreet receptacle sets.

In use, one may select a table top 30 of desired configuration and material construction and select a set of cooperating leg elements of desired style or design. For simplicity in describing one of the myriad of combinations of table top and leg sets, that is provided by a modular table assembly according to the invention, drawing FIG. 2 shows the ovoid table top of FIG. 1 with only the first receptacle set 56. Likewise, FIG. 16 shows only the second receptacle set 62, and FIG. 19 shows only the third receptacle set 68. With further reference to drawing FIGS. 2–15, the first receptacle set 56 (FIG. 2) is noted to accommodate a selection of leg sets, including post legs 32 and panel legs 34–38 (FIGS. 3–5).

Each post leg 32 (FIGS. 3 and 6) defines a table support pedestal having a table end 80 with a coupling place 82, an opposing base end 84 which may have various alternative leg feet 86, and a column portion 88 extending between the coupling plate 82 and leg foot 86. The coupling plate 82 is conveniently formed of a moldable material, including the various structural and engineering plastics and the various casting metals and alloys, such as aluminum A319, for example. As expressly shown in the drawing figures, a circular plate configuration of the coupling plate 82 readily lends itself to convenient manufacture both in terms of forming the coupling plate 82, itself, and in terms of forming the corresponding circular recesses 52 in bottom surface 50 of table top 30. The coupling plate 82 has a circumferential flange 90 (FIGS. 3, 6, and 7) that defines a mounting surface 92 to abut bottom surface 50 of table top 30. An alignment key 94 extends beyond the flange 90 and mounting surface 92, from the coupling plate 82. The alignment key 94 and circular recesses 52 have corresponding shapes and dimensions for cooperating engagement and seating of the alignment key 94 in a recess 52. Thus, each post leg 32 that is used with table top 30, a quantity of six as shown in FIG. 2, is readily located on the table top panel 30, at the point of sale. The circumferential flange 90 has an array of preferably evenly distributed screw holes 96 extending through the flange 90 for convenient screw attachment of the coupling plate 82 to the table top panel 30 with self boring wood screws 98 or the like. Extending opposite to the alignment key 94, the coupling plate 82 also has an assembly nipple 100 for cooperating engagement with a recessed seat 102 provided at either end of the column portion 88.

The column portion 88 is generally an elongated member and may be configured with any desirable table leg shape from a plain cylinder to an ornate turning, for example. The column portion 88 may be formed of any suitable structural or engineering material, including metals, woods, or plastics, for example. The specific material selected to form the column portion 88 may ultimately be dictated by aesthetic preferences. The column portion 88 is conveniently coupled with the coupling plate 82 by inserting the assembly nipple 100 into the recessed seat 102 at one end of the column portion 88 and securing the coupling plate and column portion together with a screw or bolt 104 or the like.

At the base end 84 of the column portion 88, a selected leg foot 86 is coupled with the column portion 88 by seating an assembly nipple 106 provided on the leg foot 86 into the recessed seat 102 at the base end of the column portion 88 and attaching the leg foot 86 with another screw or bolt 104. or the like, similar to the attachment between the coupling plate 82 and the column portion 88 as described above. The leg foot 86 may also be configured with a variety of shapes and formed of various materials, as discussed in greater detail above regarding coupling plate 82, with aesthetic preferences significantly affecting the specific shape and material selected to form the leg foot 86.

It will be apparent to one who is familiar with table legs and the like that alternative structure and methods for interconnecting the coupling plate 82, the column portion 88, and the leg foot 86 are available. Such alternatives may include, but not be limited to, a cooperating screw thread coupling between the coupling plate 82 and the column portion 88 and between the leg foot 86 and the column portion 88. Also, one may interconnect the coupling plate 82, the column portion 88, and the leg foot 86 with a through rod, extending through the column portion 88, between the coupling plate 82 and the leg foot 86.

Figure 6:
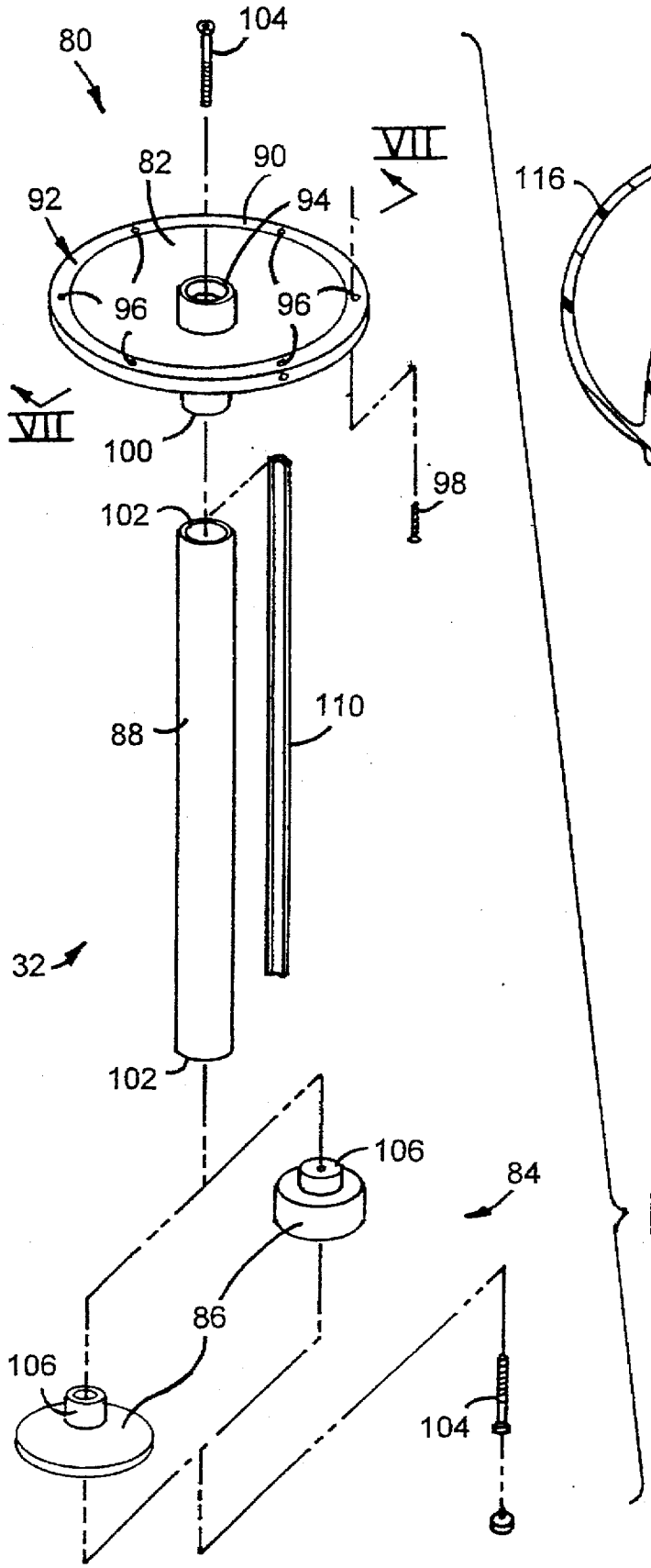
FIG. 6 is an exploded perspective view of one of the post-type legs of FIG. 3.
Figure 8:
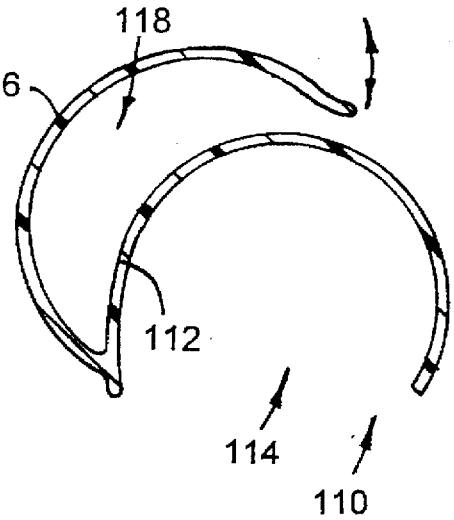
FIG. 8 is a cross-sectional view of the wire way attachment shown in FIG. 6.
Figure 7:
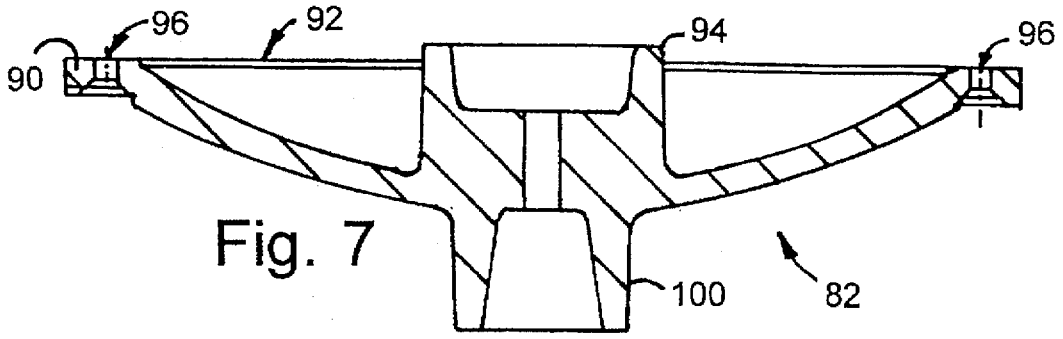
FIG. 7 is a cross-sectional view along section line VII—VII of the table end plate of FIG. 6.

Each post leg 32 may be provided with an optional, snap-on wire way 110 (FIGS. 6 and 8). The wire way 110 is preferably a single, elongated member with a first arcuate portion 112 and a second arcuate portion 116. The first arcuate portion defines an open-sided channel 114 that is shaped and sized for snap-fit fastening with or attachment to the column portion 88. The second arcuate portion 116 that extend outward from the first arcuate portion 112 and curves back toward the first arcuate portion 112 to define a wire way passage 118 between the first 112 and second 116 arcuate portions. In a first position, the wire way passage 118 is substantially closed-sided (FIG. 8). At least the second arcuate portion 116, however, is flexible to be displaced from the first position to a second position in which the wire way passage 118 is open-sided to receive an item into or remove an item from the passage 118. At least the second arcuate portion 116 is also resilient to return from the second or open position to the first or substantially closed position. To obtain a wire way structure that achieves the use discussed here, the wire way 110 may be formed by a variety of methods and of various resilient and flexible materials. The wire way as specifically disclosed in the Figures and described here is conveniently produced by extruding a polyvinylchloride (PVC) plastic and cutting the extrusion to a desired length for use.

In addition to the post leg 32 described above, panel legs 34–38 (FIGS. 4 and 5) may also be used with the first receptacle set 56 (FIG. 2). Each of the panel legs 34–38 are quite similar to one another with only small differences among them. Thus, panel leg 34 will be discussed in greater detail with only the differences of panel legs 36 and 38 being discussed further below.

Similar to post leg 32, panel leg 34 (FIGS. 4 and 9) is generally a table support pedestal with a column portion 120 extending between a table end 122 and a base end 124. The column portion 120 may be of any suitable construction to provide a table support of desired design, including solid, laminated, and framed construction, for example. The column portion 120 may also be fabricated of any suitable material, including metals, plastics, and woods, for example. The ultimate construction and material choices will, as always, be significantly affected by the desired aesthetic result. Panel leg 34 has two edge coupling plates 126 at the table end 122 of the leg 34 to couple the leg 34 with the bottom surface 50 of table top 30.

As with the coupling plate 82 of the post leg 32, the edge coupling plate 126 is conveniently formed of a moldable material, including the various structural and engineering plastics and the various casting metals and alloys, such as aluminum A319, for example. The edge coupling plate 126 is also preferably a circular plate member having a circumferential flange 128 defining a mounting surface 130, with an array of screw holes 132 extending through the flange 128 for attachment to bottom surface 50 with screws 98. The flange 128 of the edge coupling plate 126 is interrupted, however, by a radially extending mounting slot 134 that is sized and dimensioned to receive an edge of the column portion 120.

A planar plate portion 136 of the coupling plate defines each side of the mounting slot 134 and is provided with screw holes 138 for screw fastening attachment of the mounting plate 126 to the column portion 120. A generally circular or semi-circular alignment key 140 extends beyond the mounting surface 130, defined by the circumferential flange 128. The alignment key 140 is shaped and sized for cooperating engagement with and seating of alignment key 140 in the circular recesses 52 of the first receptacle set 56. The alignment key 140 also extends at least partially over the mounting slot 134 to define a stop surface 142 for positive location of the column portion 120 with respect to the edge coupling plate 126. Further, the alignment key 140 may be provided with a projecting ridge 144 or other indexing feature and the table end 122 of the column portion 120 may be provided with a cooperating recess 146 to further facilitate positive location of the column portion 120 with respect to the edge coupling plate 126.

At the base end 124 of panel leg 34, a leg foot 148 and a trim member 150 may be provided and attached to the column portion 120 in accordance with desired aesthetics. One of many suitable configurations includes fabricating the leg foot 148 as a structural foundation member with the trim member 150 being an overlaying decorative piece, for example. Each of the leg foot 148 and the trim member 150 may be fabricated of any suitable material.

A wire way may also be provided for panel leg 34 by attaching a hollow, elongated member 160 (FIGS. 9 and 10) to a side of the column portion 120. More preferably, the wire way or elongated member 160 is set into a groove 162 that corresponds to the cross-sectional shape of the wire way 160, defined in a side of the column portion 120. The wire way 160 may be glued, screwed, or taped with double-sided tape or the like into the groove 162 as is commonly known and understood by those of ordinary skill in the art. More particularly, the wire way 160 is preferably a substantially closed-sided member having a slotted side 164 that is defined by at least one flexible member 166, but more preferably two flexible members 166. In a first position, the flexible members 166 substantially close the side 164 of the wire way passage 168. The flexible members 166 are flexible to be deflected to a second position in which the passage is open to receive an item 170, such as a cord or cable or the like, into or remove an item from the passage 168. The flexible members 166 are resilient to return to the first position from the second position when an item is not being transferred into or out of the passage 168. As with the wire way I 10 for the post leg 32, discussed in greater detail above, the wire way 160 may be fabricated by a number of methods from various materials. The wire way 160 may be conveniently fabricated as a length of a dual durometer extrusion of PVC to define a substantially rigid plastic member with resilient flexible members 166.

As is seen in FIG. 4, panel leg 36 is substantially the same as panel leg 34, except that a center portion of the column portion is removed to define two column portions 176. Further, the wire way 160 may also be relocated to an inside edge of one or both of the resulting two column portions 176. Pedestal legs 38 and 38' (FIGS. 5 and 12) are also substantially the same as pedestal leg 34, except that the wire way 160 is relocated to an edge of the column portion 178 and one of the two edge coupling plates 126 is replaced with a side coupling plate 180 (FIGS. 5 and 12–15). The side coupling plate 180 is generally a half of the edge coupling plate 126.

The side coupling plate 180 (FIGS. 5 and 12–15) is fabricated of a suitable material to provide a semi-circular plate member having a semi-circumferential flange 182 and two mounting tabs 194 that define a mounting surface 184 to abut bottom surface 50 of table top 30. The semi-circumferential flange 182 is provided with an array of screw holes 186 to screw mount the side coupling plate 180 to bottom surface 50 of the table top 30 with screws 98. The side coupling plate 180 also has a diametrical side surface 188 with screw holes 190 and each tab 194 has a screw hole 192, to screw mount the side coupling plate 180 the column portion with tabs 194 seating in recesses 146.

An alignment key 200 extends beyond the mounting surface 184 defined by the semi-circumferential flange 182 and tabs 194, at a top edge of the side surface 188. The alignment key 200 is a generally ovoid member that is configured and sized for cooperating engagement with and seating into the ovoid recesses 54 of first receptacle set 56. The ovoid recess 54 extends along an axis 202 that generally aligns with a circular recesses 52 of the first receptacle set 56.

Figure 18:
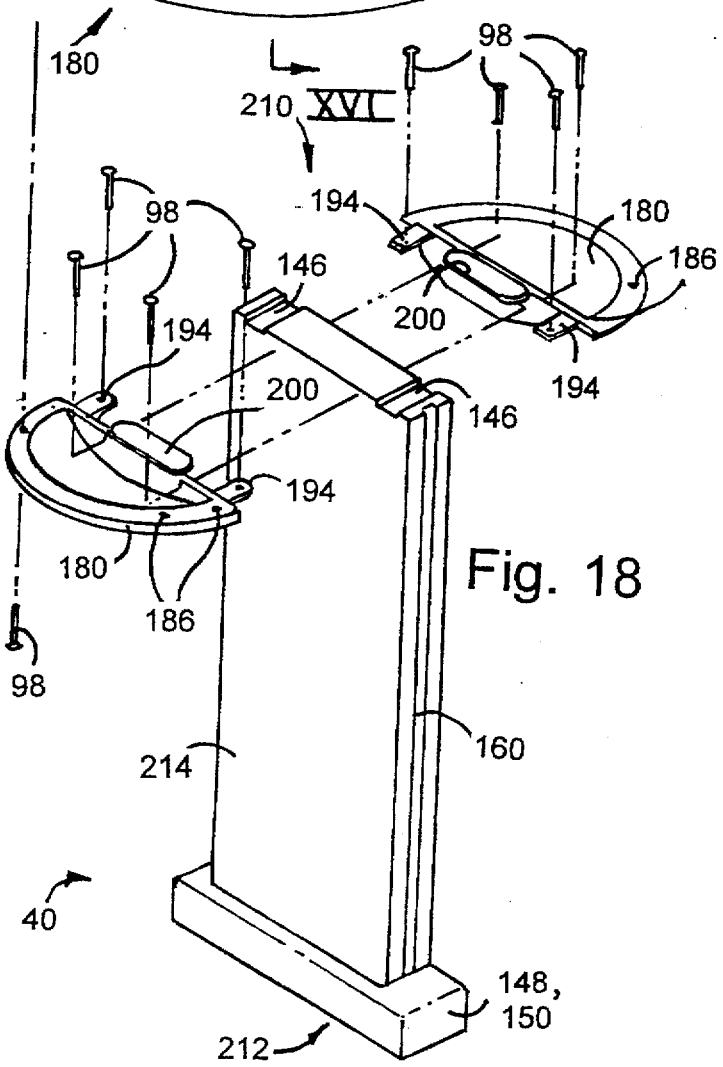
FIG. 18 is an exploded perspective view of one of the legs shown in FIG. 17.
Figure 17:
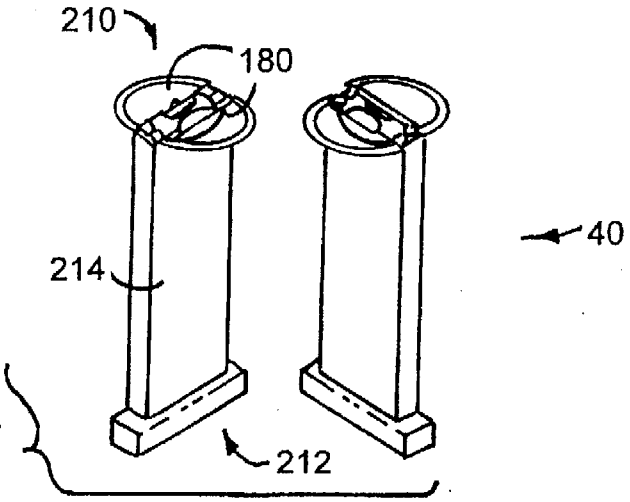
FIG. 17 is a perspective view of two small panel legs configured for use with the receptacle set shown in FIG. 16

More particularly regarding drawing FIGS. 16–18, an ovoid table top panel member 30 with only the second receptacle set 62 is shown in FIG. 16. The second receptacle set 62 includes pairs of ovoid recesses 60 that extend along axes 204. The second receptacle set 62 accommodates a selection of leg sets having a table end configuration similar to that of small panel legs 40 (FIGS. 17 and 18) and the like. Each of legs 40 defines a table support pedestal having a table end 210 with a pair of side coupling plates 180, an opposing base end 212 which may have various foot and trim components, similar to panel legs 34, and a column portion 214 extending between the opposing table end 210 and base end 212. The side coupling plate 180 is disclosed in detail above.

Similar to the panel leg 38, the table end 210 of the column portion 214 is provided with indexing recesses 146 that receive the tabs 194 of side coupling plates 180. The table end 210 of the small pedestal leg; 40 has two side coupling plates 180 and thus, presents two alignment keys 200. The cooperating leg receptacles 60 are, therefore, a pair of ovoids configured with corresponding shape and dimensions for cooperating engagement and seating of the two alignment keys 200 in the recess 60. Also as discussed above, side coupling plates 180 are attached to bottom surface 50 of table top panel 30 with screws 98. Further, the legs 40 may be provided with a wire way 160 as is also discussed in greater detail above.

More particularly regarding; drawing; FIGS. 19–22, FIG. 19 shows table top panel 30 with only the third receptacle set 68. Preferably, an array of at least three generally keyhole-shaped recesses 66 define the third receptacle set 68. Each elongated recessed 66 extends along; an axis 216. Each elongated recess 66 is oriented so its axis 216 intersects the axis 216 of each other elongated recess 66 at a common point. The third receptacle set 68 is noted to accommodate a selection of pedestal legs 42–48. Each of these pedestal legs 42–48 is quite similar. Legs 42, 44, and 46 are, in fact, substantially the same with only a substitution in column portion 220 generally distinguishing one from another. Thus, pedestal leg 46 will be discussed in greater detail below, with only the differences among the legs being specifically discussed further.

Pedestal leg 46 has a table end 222 with a spider coupling member 224, an opposing base end 226 which may have various alternative base members 228, and a column portion 220 extending between the table end 222, and the base end 226. The spider 224 is conveniently formed of a moldable material, including various structural and engineering; plastics and the various casting metals and alloys, such as aluminum A319, for example. As is expressly shown in the drawing Figures, the spider 224 may be provided with four radially extending arms 230, each of which terminates at a hand portion 232. Each hand 232 presents a generally keyhole-shaped mounting surface 234 to abut the bottom surface 50 of the table top panel 30. Thus, each recess 66 has a corresponding keyhole-shape that is dimensioned for cooperating engagement and seating of each hand 232 of the spider 224 into the recess 66. Each hand 232 is provided with an array of screw holes 236, by which the spider 224 is screw fastened with screws 98 to the table top 30. The arms 230 of the spider 224 preferably extend radially outward to the hand portions 232 from a central hub 238 which is offset and spaced away from the table top 30.

The column portion 220 of pedestal leg 46 includes an elongated member that defines a hollow tube 240. The tube 240 may have virtually any cross-sectional shape and may be constructed of any of various appropriate materials, including woods, plastics, and metals, for example. Those who practice the invention may, however, find that some cross-sectional shapes may lend themselves more naturally to the assembly of the pedestal leg 46 than alternative shapes. The tube 240 is mated or coupled with the spider 224 by inserting the offset hub 238 and a portion of the arms 230 into an open end 242 of the tube 240.

The column portion 220 may also provide a wire way through an opening 248 through spider hub 238, through the tube 240, and out an opening 254 at the base end 226. A guide 244 may also be provided in tube 240 to direct an item from table end 222 to the opening 254 at the base end 226. The guide 244 is particularly useful with a tube 240 that has a relatively large diameter. The guide 244 may be constructed of any of various appropriate materials and most preferably has an elliptical shape, although other shapes may be found to function adequately.

Each end of tube 240 is provided with a trim ting 246 that may be constructed as a length of an open-sided channel member extruded of PVC plastic, or the like. Similarly, the opening 254 is also provided with a trim ring 256. Of course, those who practice the invention will realize that other materials and construction techniques may be suitable to provide alternative trim rings.

The base 228 of the pedestal leg 46 may be any functionally suitable and aesthetically pleasing foundation member. As specifically disclosed in the drawing Figures, base 228 is generally a circular disc member that is cast with a suitable material, such as aluminum A319. The base 228 may alternatively be cast of some other suitable metal or a plastic and may also be formed as a turning from wood stock, for example. As is specifically shown in the drawing FIGS. 20–22, base 228 is most preferably formed with an array of concentric ridges or steps 250. The ridges or steps 250 are spaced to correspond with the tube 240 and to provide a positive locating stop to position the base 228 and the tube 240 relative to one another.

Figure 22:
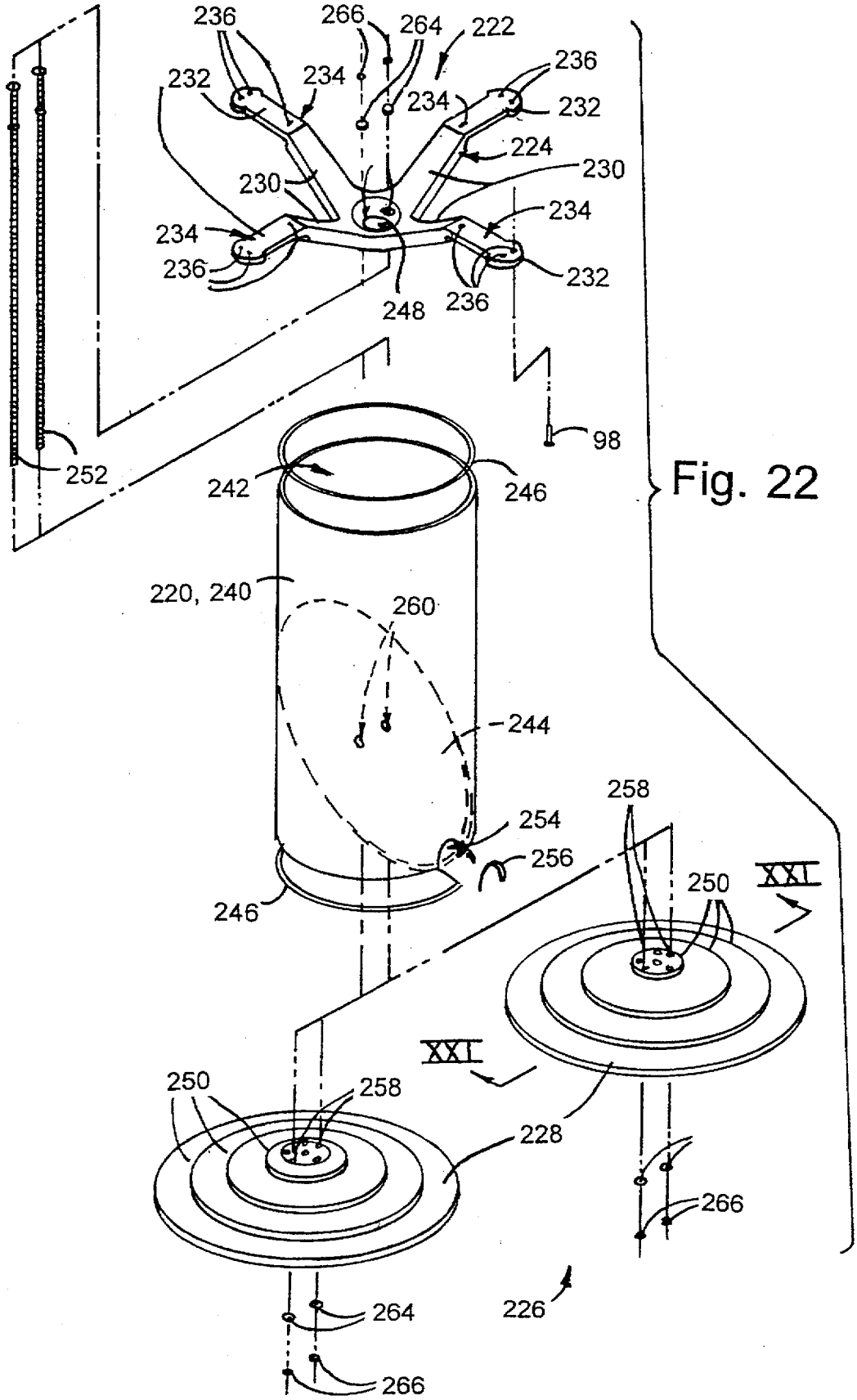
FIG. 22 is an exploded perspective view of a pedestal leg, shown in FIG. 20.

As shown in drawing FIG. 22, the spider 224, the column 220, and the base 228 are preferably interconnected with a pair of threaded rods 252. The rods 252 extend through holes 258 in the base 228, extend up through tube 238 and holes 260 that are provided in the guide 244, and extend through holes 262 in the hub 238 of the spider 224. Cooperating washers 264 and nuts 266 are fastened at each end of the rods 252 to secure the pedestal leg 46 together.

Figure 20:
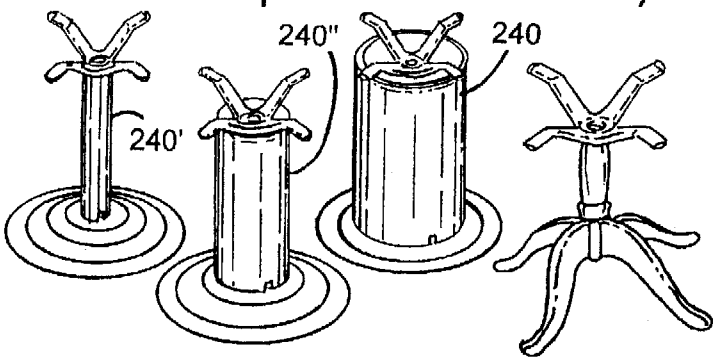
FIG. 20 is a perspective view of four pedestal legs configured for use with the receptacle set shown in FIG. 19.
Figure 21:
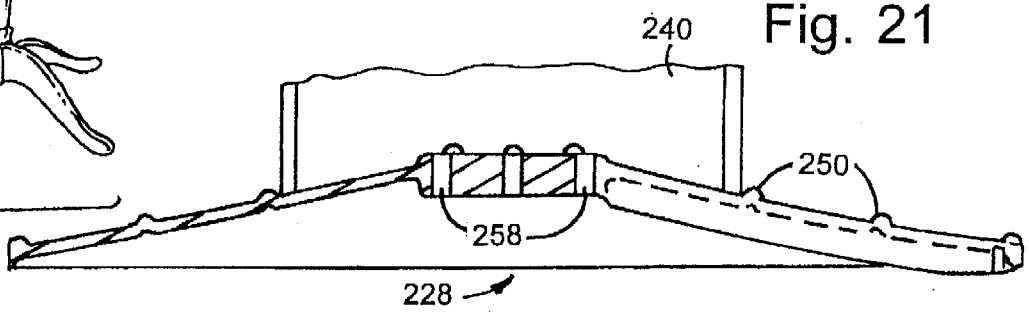
FIG. 21 is a cross-sectional view along section line XXI—XXI of a leg base, shown in FIG. 22.

As is clearly shown in drawing FIG. 20, pedestal legs 42 and 44 differ from pedestal leg 46 by the substitution of different sized tubes 240' and 240". Pedestal leg 48 differs from pedestal leg 46 by the substitution of an alternative column portion and an alternative base.

With the preceding description of the table top panel 30 and the various legs, namely, post legs 32 (FIGS. 3 and 6), panel legs 34 and 36 (FIGS. 4 and 9), panel legs and 38 and 38' (FIGS. 5 and 12), small panel legs 40 (FIGS. 17 and 18), and pedestal legs 42, 44, 46, and 48 (FIGS. 20 and 22), the many design possibilities provided by the selection, mixing, and matching of the legs with the table top will be understood. It will also be understood by those who practice the invention and by those skilled in the art, that various modifications and improvements may be made to the invention without departing from the spirit of the disclosed concept. The scope of protection afforded is to be determined by the claims and by the breadth of interpretation allowed by law.

The embodiments of the invention in which an exclusive property or privilege is claimed are defined as follows:

1. A modular table kit adapted for assembly of a modular table with any of a plurality of leg configurations, the kit comprising:

a table top panel;

a plurality of receptacle sets adapted to be selectively coupled to the table top panel, each receptacle set including a plurality of receptacles, each receptacle set having at least one receptacle of a different shape than at least one of the receptacles of any of the other receptacle sets; and a plurality of different types of leg sets, each leg set of said plurality of leg sets being adapted to be selectively coupled to at least one, but not all, of the plurality of leg receptacle sets, wherein the modular table can be selectively assembled in one of the plurality of configurations by coupling at least one of the plurality of receptacle sets to the table top panel and by coupling at least one of the plurality of leg sets to at least one of the receptacle sets, the table top panel thereby being interconnected to at least one of the plurality of leg sets.

2. The modular table kit defined in claim 1, further including a plurality of coupling members, each coupling member of said plurality of coupling members being adapted to interconnect a selected leg of said plurality of leg sets and a selected receptacle of said plurality of receptacle sets.

3. The modular table kit defined in claim 2, wherein at least one coupling member of said plurality of coupling members includes an alignment key which has a shape and dimension that corresponds to and is adapted to be seated in a cooperating receptacle of said plurality of receptacle sets.

4. The modular table kit defined in claim 1, wherein at least one receptacle set of said plurality of receptacle sets includes one of an array of pairs of circular recesses, an array of pairings of a circular recess and an ovoid recess, an array of pairs of ovoid recesses, and an array of groupings of at least three elongated recesses.

5. The modular table kit defined in claim 1, wherein at least one leg of said plurality of leg sets has a passage extending away from said table top panel.

6. The modular table kit defined in claim 5, wherein said passage includes a member that defines a side of said passage, said member being flexible to be displaced from a first position in which said passage is substantially closed-sided sided to a second position in which said passage is open-sided to receive an item into or remove an item from said passage, through said side of said passage, said member being resilient to return to said first position from said second position.

7. The modular table kit defined in claim 6, wherein said passage is defined by a separate member that is connected with said at least one leg.

8. The modular table kit defined in claim 6, wherein said passage has two opposing ends, includes an opening at one of said two opposing ends, and includes a guide near said one of said two opposing ends, said guide directing an item from the other of said two opposing ends to said opening at said one of said two opposing ends.

9. A modular table kit comprising:

a panel member;

a plurality of different types of receptacle sets disposed on said panel member, each receptacle set including a plurality of receptacles;

a plurality of different types of leg sets, each leg of each of said different leg sets including one or mounting elements configured to be received within the receptacles of one of said receptacle sets, whereby each leg set of said plurality of leg sets is adapted to couple only with a selected one of the different types of said plurality of receptacle sets;

a plurality of coupling members, each coupling member of said plurality of coupling members being adapted to be interposed in coupling engagement between a selected leg of said plurality of leg sets and a selected receptacle of said plurality of receptacle sets; and a plurality of wireways, each wireway of said plurality of wireways adapted to be mounted on a leg of each of said plurality of leg sets.

10. The modular table kit defined in claim 9, wherein at least one coupling member of said plurality of coupling members includes an alignment key which has a shape and dimension that corresponds to and is adapted to be seated in a cooperating receptacle of said plurality of receptacle sets.

11. The modular table kit defined in claim 9, wherein at least one receptacle set of said plurality of receptacle sets includes one of an array of pairs of circular recesses, an array of pairings of a circular recess and an ovoid recess, an array of pairs of ovoid recesses, and an array of groupings of at least three elongated recesses.

12. The modular table kit defined in claim 9, wherein at least one leg of said plurality of leg sets has a passage extending away from said table top panel.

13. The modular table kit defined in claim 12, wherein said passage includes a member that defines a side of said passage, said member being flexible to be displaced from a first position in which said passage is substantially closed-sided to a second position in which said passage is open-sided to receive an item into or remove an item from said passage, through said side of said passage, said member being resilient to return to said first position from said second position.

14. The modular table kit defined in claim 13, wherein said passage is defined by a separate member that is connected with said at least one leg.

15. The modular table kit defined in claim 13, wherein said passage has two opposing ends, includes an opening at one of said two opposing ends, and includes a guide near said one of said two opposing ends, said guide directing an item from the other of said two opposing ends to said opening at said one of said two opposing ends.

16. A modular table kit, comprising:

at least one table top panel having at least first and second receptacle sets; and at least first and second leg sets;

each of the plurality of receptacle sets including a plurality of recesses which are shaped and arranged to form distinct receptacle patterns;

the first leg set including a plurality of legs of a first type, each of the legs of the first type including one or more coupling members configured to be received in and coupled to one or more recesses of the first receptacle set, the one or more coupling members of the legs of the first leg set being configured to prevent receipt within and coupling thereof to the recesses of the second receptacle set;

the second leg set including a plurality of legs of a second type, each of the legs of the second type including one or more coupling members configured to be received in and coupled to one or more recesses of the second receptacle set, the one or more coupling members of the legs of the second leg set being configured to prevent receipt within and coupling thereof to the recesses of the first receptacle set.

17. The modular table kit defined in claim 16 wherein at least one receptacle set of said plurality of receptacle sets includes one of an array of pairs of circular recesses, an array of pairings of a circular recess and an ovoid recess, an array of pairs of ovid recesses, and an array of groupings of at least three elongated recesses.

18. The modular table kit defined in claim 17, wherein at least one leg of said plurality of leg sets has a passage extending away from said table top panel.

19. The modular table kit defined in claim 18, wherein said passage includes a member that defines a side of said passage, said member being flexible to be displaced from a first position in which said passage is substantially closed-sided to a second position in which said passage is open-sided to receive an item into or remove an item from said passage, through said side of said passage, said member being resilient to return to said first position from said second position.

20. The modular table kit defined in claim 19, wherein said passage is defined by a separate member that is connected with said at least one leg.

21. The modular table kit defined in claim 19, wherein said passage has two opposing ends, includes an opening at one of said two opposing ends, and includes a guide near said one of said two opposing ends, said guide directing an item from the other of said two opposing ends to said opening at said one of said two opposing ends.

22. A modular table assembly comprising:

a panel member;

a plurality of different types of receptacle sets disposed on said panel member; and a plurality of leg sets, each leg of said plurality of leg sets corresponding to a respective receptacle set of said plurality of receptacle sets, a selected leg set of said plurality of leg sets being coupled only with its respective receptacle set to assemble a table having a selected design style, at least one leg of said plurality of leg sets having a table end, an opposing base end, and a column portion extending between said table end and said base end, said table end including a cooperating key that corresponds to and is seated in a predetermined receptacle of said plurality of receptacle sets, said at least one leg further including a passage extending between said table end and said base end, said leg having a member that defines a side of said passage, said member being flexible to be displaced from a first position in which said passage is substantially closed-sided to a second position which said passage is open-sided to receive an item into or remove an item from said passage, through said side of said passage, said member being resilient to return to said first position from said second position, said passage being defined by a wireway member which is separate from said at least one leg, said wireway member being a snap-on wireway which is sized and shaped to fit onto said at least one leg.

23. The modular table assembly defined in claim 22, wherein said snap-on wireway includes a fastener which is an open-sided channel member.

24. The modular table assembly defined in claim 22, wherein said passage includes an opening at one of said table end and said base end and a guide near said one of said table end and said base end, said guide directing an item from the other of said table end and said base end to said opening at said one of said table end and said base end.

25. The modular table assembly defined in claim 22, wherein at least one leg of said plurality of leg sets includes a cooperating key that corresponds to and is seated in a predetermined receptacle of said plurality of receptacle sets.

26. The modular table assembly defined in claim 22, wherein said at least one leg of said plurality of leg sets includes a passage extending along a length of said leg between a table end of said leg and an opposing base end of said leg.

27. The modular table assembly defined in claim 26, wherein said passage includes a member that defines a side of said passage, said member being flexible to be displaced from a first position in which said passage is substantially closed-sided to a second position in which said passage is open-sided to receive an item into or remove an item from said passage, through said side of said passage, said member being resilient to return to said first position from said second position.

28. The modular table assembly defined in claim 27, wherein said passage is defined by a wire way member that is separate from said at least one leg.

29. The modular table assembly defined in claim 28, wherein said wireway member is a snap-on wireway which is sized and shaped to fit onto said at least one leg.

30. The modular table assembly defined in claim 29, wherein said snap-on wireway includes a fastener which is an open-sided channel member.

31. The modular table assembly defined in claim 26, wherein said passage includes an opening at one of said table end and said base end and a guide near said one of said table end and said base end, said guide directing an item from the other of said table end and said base end to said opening at said one of said table end and said base end.

* * * * *

UNITED STATES PATENT AND TRADEMARK OFFICE

CERTIFICATE OF CORRECTION

PATENT NO. : 5,718,179
DATED : February 17, 1998
INVENTORS : Timothy K. Johnson and Mary Lou Brodbeck It is certified that error appears in the above-identified patent and that said Letters Patent is hereby corrected as shown below:

*Column 2, line 2;

"discreet" should be --discrete--.

*Column 2, line 30;

"discreet" should be --discrete--.

*Column 2, line 36;

"discreet" should be --discrete--.

*Column 2, line 55;

After "panel legs", delete "and".

Column 4, line 10;

"104." should bee --104--.

*Column 4, line 36;

"extend" should be --extends--.

*Column 5, line 35;

"feature" should be --features--.

UNITED STATES PATENT AND TRADEMARK OFFICE

CERTIFICATE OF CORRECTION

PATENT NO. : 5,718,179
DATED : February 17, 1998
INVENTORS : Timothy K. Johnson and Mary Lou Brodbeck It is certified that error appears in the above-identified patent and that said Letters Patent is hereby corrected as shown below:

Column 6, line 1;

"I 10" should be --110--.

*Column 6, line 38;

Delete "a" after "with"

*Column 7, line 5;

"recessed" should be --recess--.

Column 7, line 58;

"ting" should be --ring--.

*Column 8, line 27;

After "panel legs", delete "and".

Column 9, claim 6, line 19;

Delete "sided" (Second Occurrence)

UNITED STATES PATENT AND TRADEMARK OFFICE

CERTIFICATE OF CORRECTION

PATENT NO. : 5,718,179
DATED : February 17, 1998
INVENTOR(S) : Timothy K. Johnson and Mary Lou Brodbeck It is certified that error appears in the above-identified patent and that said Letters Patent is hereby corrected as shown below:

*Column 9, claim 9, line 39;

"or" should be –of–.

Column 10, claim 17, line 49;

"ovid" should be –ovoid–.

Signed and Sealed this

Tenth Day of November 1998

*Attest:*

Bruce Lehman

BRUCE LEHMAN

*Attesting Officer*

*Commissioner of Patents and Trademarks*